US010196717B2

(12) United States Patent
Maki et al.

(10) Patent No.: US 10,196,717 B2
(45) Date of Patent: Feb. 5, 2019

(54) PLATED STEEL SHEET FOR HOT PRESSING, HOT PRESSING METHOD FOR PLATED STEEL SHEET, AND AUTOMOBILE PART

(71) Applicant: NIPPON STEEL & SUMITOMO METAL CORPORATION, Tokyo (JP)

(72) Inventors: Jun Maki, Tokyo (JP); Shintaro Yamanaka, Tokyo (JP); Masao Kurosaki, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 264 days.

(21) Appl. No.: 14/784,691

(22) PCT Filed: Apr. 14, 2014

(86) PCT No.: PCT/JP2014/060588
§ 371 (c)(1),
(2) Date: Oct. 15, 2015

(87) PCT Pub. No.: WO2014/171417
PCT Pub. Date: Oct. 23, 2014

(65) Prior Publication Data

US 2016/0060735 A1 Mar. 3, 2016

(30) Foreign Application Priority Data

Apr. 18, 2013 (JP) ..... 2013-087772

(51) Int. Cl.
*C22C 38/14* (2006.01)
*C23C 2/12* (2006.01)
(Continued)

(52) U.S. Cl.
CPC ..... *C22C 38/14* (2013.01); *C22C 21/00* (2013.01); *C22C 21/06* (2013.01); *C22C 38/002* (2013.01);
(Continued)

(58) Field of Classification Search
CPC ..... C22C 38/14; C22C 21/00; C22C 21/06; C22C 38/002; C22C 38/04; C23C 2/12; C23C 2/28
See application file for complete search history.

(56) References Cited

U.S. PATENT DOCUMENTS 8,986,849 B2 3/2015 Maki et al.
2012/0073351 A1 3/2012 Maki et al.

FOREIGN PATENT DOCUMENTS

EP 2270257 A1 1/2011
JP 2000-38640 A 2/2000
(Continued)

OTHER PUBLICATIONS

Machine translation of JP 2012-092365 (Year: 2012).*
(Continued)

*Primary Examiner* — John E Uselding
(74) *Attorney, Agent, or Firm* — Birch, Stewart, Kolasch & Birch, LLP

(57) ABSTRACT

To provide a plated steel sheet for hot pressing, a hot pressing method for the plated steel sheet, and an automobile part made by the hot pressing method that has an excellent lubricity with less deposition amount and can improve formability and productivity in hot pressing work and also can improve chemical conversion treatability after hot press forming, there is provided an Al plating layer formed on one side or both sides of the steel sheet, the Al plating layer containing at least Al, and further containing one or more elements, at a total content of 0.02 to 2 mass %, selected
(Continued)

from Mg, Ca, Sr, Li, Na, and K; and a surface coating layer laminated on the Al plating layer and containing at least ZnO.

5 Claims, 2 Drawing Sheets

(51) Int. Cl.

| | |
|---|---|
| ***C23C 2/28*** | (2006.01) |
| ***C22C 21/00*** | (2006.01) |
| ***C22C 21/06*** | (2006.01) |
| ***C22C 38/04*** | (2006.01) |
| ***C22C 38/00*** | (2006.01) |
| ***C22C 38/02*** | (2006.01) |
| ***C22C 38/06*** | (2006.01) |

(52) U.S. Cl.
CPC ..... *C22C 38/02* (2013.01); *C22C 38/04* (2013.01); *C22C 38/06* (2013.01); *C23C 2/12* (2013.01); *C23C 2/28* (2013.01)

(56) References Cited

FOREIGN PATENT DOCUMENTS

| | | | |
|---|---|---|---|
| JP | 2003-129209 | A | 5/2003 |
| JP | 2004-211151 | A | 7/2004 |
| JP | 4264373 | B2 | 5/2009 |
| JP | 2011-137210 | A | 7/2011 |
| JP | 2012-92365 | A | 5/2012 |
| JP | 2012-112010 | A | 6/2012 |
| RU | 2466210 | C2 | 11/2012 |
| WO | WO 2009/131233 | A1 | 10/2009 |
| WO | WO 2012/137687 | A1 | 10/2012 |

OTHER PUBLICATIONS

Machine translation of JP 2011-137210 (Year: 2012).*
International Search Report, issued in PCT/JP2014/060588, dated Jul. 15, 2014.
Written Opinion of the International Searching Authority, issued in PCT/JP2014/060588, dated Jul. 15, 2014.
Korean Office Action issued in corresponding Korean Application No. 10-2015-7029288 dated Feb. 21, 2017, together with an English translation thereof.
Russian Office Action and Search Report issued in corresponding Russian Application No. 2015144333 dated Mar. 23, 2017, together with an English translation thereof.
Extended European Search Report, dated Oct. 25, 2016, for European Application No. 14785423.6.
Chinese Office Action, dated Mar. 13, 2017, for corresponding Chinese Application No. 201480021499.2, with a partial English translation.
European Office Action, dated Oct. 25, 2018, for corresponding European Application No. 14785423.6.

* cited by examiner

PLATED STEEL SHEET FOR HOT PRESSING, HOT PRESSING METHOD FOR PLATED STEEL SHEET, AND AUTOMOBILE PART

TECHNICAL FIELD

The present invention relates to a plated steel sheet for hot pressing, a hot pressing method for the plated steel sheet, and an automobile part.

BACKGROUND ART

Recently, it has been increasingly demanded to restrain the consumption of fossil fuels in order to control global warming and protect the environment, which has affected various manufacturing industries. For example, automobiles, which are an indispensable part of transportation means in daily life and activities, are not exception. There is a demand to improve fuel economy by, for example, reducing vehicle body weight. It is not allowed, however, to simply reduce the vehicle body weight by neglecting product qualities. It is necessary to secure appropriate safety.

Many of the structural parts of an automobile are made of steel, in particular a steel sheet. For reducing the vehicle body weight, it is important to reduce the weight of the steel sheet. Instead of simply reducing the weight of the steel sheet, which is not allowed as mentioned above, the weight reduction must be accompanied with maintaining the mechanical strength of the steel sheet. Such demand becomes higher not only in the car manufacturing industry but also in various other manufacturing industries. Research and development efforts have been directed to a steel sheet that can have the same or a larger mechanical strength as compared to conventional one even when the sheet is made thinner.

In general, a material having a high mechanical strength tends to become lower in formability and shape fixability in shape formation work such as bending. It is difficult to carry out the process for forming such material into a complicated shape. One of the solutions to the formability problem is what is called "a hot pressing method (also referred to as hot stamping, hot pressing, die quenching, press hardening)". In the hot pressing method, a material to be formed is heated temporarily to a high temperature (in an austenite region) and the steel sheet soften by the heating is formed by pressing. The steel sheet is then cooled. By using the hot pressing method, the material is once soften by heating to a high temperature so that the material is easy to be pressed. The mechanical strength of the material becomes larger due to a quenching effect during cooling after the shaping is completed. Accordingly, the hot pressing can provide a product having both a good shape fixability and a high mechanical strength.

When the hot pressing method is applied to a steel sheet, however, iron and other substances on the surface are oxidized to generate scales (oxides) due to heating to a high temperature of, for example, 800° C. or more. Accordingly, a descaling process is necessary after hot pressing to remove the scales, which deteriorates productivity. For the members and the like that require corrosion resistance, it is necessary to carry out anti-corrosion treatment and metal cover installation on the surfaces of the members after the shaping process. A surface cleaning process and a surface treatment process are also necessary, which further deteriorates productivity.

As an example of restraining such deterioration in productivity, a covering layer can be installed on a steel sheet. In general, various materials including organic and inorganic materials are used for the covering layer on a steel sheet. Among them, galvanized steel sheets that have a sacrificial protection effect on steel sheets are widely used for steel sheets for automobiles and other products because the galvanized steel sheets provide a good anti-corrosion effect and suitability to steel sheet production technology. However, this may cause to considerable deterioration in the surface properties because heating temperatures used in the hot pressing (700 to 1000° C.) are higher than the temperatures at which the organic materials decompose or the zinc boils so that the plating layer evaporates at a time of heating by hot press.

For this reason, it is desirable to use, for example, what is called an Al-plated steel sheet for the hot pressing that heats the steel sheet to high temperatures. The Al-plated steel sheet is a steel sheet having an Al-based metal cover that has the boiling point higher than that of an organic material cover or Zn-based metal cover. The Al-based metal cover can prevent scales from depositing on the surface of the steel sheet, which leads to omitting a process such as the descaling process and improving productivity. The Al-based metal cover also has an anti-corrosion effect so that the corrosion resistance of the steel sheet after coated with paint is improved. Patent Literature 1 listed below discloses a method for using an Al-plated steel sheet in hot pressing, the Al-plated steel sheet being obtained by covering a steel sheet having predetermined steel components with Al-based metal, as explained above.

In the case that the Al-based metal cover is applied, the Al cover is melted and transformed into an Al—Fe compound due to the dispersion of Fe from the steel sheet, depending on preheating conditions before hot pressing. The Al—Fe compound grows until the Al—Fe compound reaches to the surface of the steel sheet. The compound layer is hereinafter referred to as the alloy layer. The alloy layer is so hard that scratches are formed by contacting with dies during the pressing work.

That is because the Al—Fe alloy layer is intrinsically not smooth on the surface and is inferior in lubricity, comparatively. In addition, since the Al—Fe alloy layer is comparatively hard, the Al—Fe alloy layer tends to break, develop cracks in a plating layer, and come off in a powder form. Moreover, flaked materials from the Al—Fe alloy layer and coming-off materials by strong abrasion on the Al—Fe surface attach on the dies. The Al—Fe compound then adheres to and deposits on the dies, which leads to deterioration in the quality of pressed products. To prevent this, it is necessary to remove Al—Fe alloy powder adhered to the dies during maintenance, which is one of the causes for lowering productivity and increasing the cost.

Furthermore, the Al—Fe alloy layer is less reactive in phosphate treatment so that a chemical conversion coating (a phosphate coating), which is a treatment before electrodeposition painting, is not generated. Although the chemical conversion coating is nor formed, the Al—Fe alloy layer itself has a good coating adhesion ability with paint so that corrosion resistance after coated with paint becomes better if Al plating deposition amount is large enough. An increase in the Al plating deposition amount, however, tends to worsen the aforementioned adhesion to the dies. The adhesion occurs in the cases that the flaked materials from the Al—Fe alloy layer attach on the dies or the coming-off materials by strong abrasion on the Al—Fe surface attach on the dies, as described above. An increase in the lubricity of the surface coating makes an improvement for the case that coming-off materials by strong abrasion on the Al—Fe surface attach on the dies. On the other hand, this improvement effect is relatively small for the case that flaked materials from the Al—Fe alloy layer attach on the dies. To alleviate the adhesion due to the flaked materials from the Al—Fe alloy layer, it is most effective to lower the Al plating deposition amount. However, lowering the deposition amount causes deterioration in the corrosion resistance as described above.

To address this issue, Patent Literature 2 listed below discloses a steel sheet with an objective to prevent scratches from occurring during work. The Patent Literature 2 proposes that an Al-based metal cover is formed on a steel sheet having predetermined steel components, and, on the Al-based metal cover, there is formed a coating made of an inorganic compound containing at least one of Si, Zr, Ti, and P, an organic compound, or a complex compound thereof. For the steel sheet with such surface coating formed thereon, the surface coating still remains during pressing work after heating so that the surface coating can prevent scratches from forming during pressing. In addition, the literature claims that the surface coating can also act as a lubricant during the pressing work, which allows to improve formability. In reality, however, a sufficient lubricity cannot be obtained and a new lubricant or an alternative means is still desired.

Patent Literature 3 listed below discloses a method related to the hot pressing of a galvanized steel sheet. The method addresses the surface degradation due to evaporation of a galvanized layer on the surface. The method according to the Patent Literature 3 relates to the forming of a barrier layer of zinc oxide (ZnO), which has the high melting point, on the surface of the galvanized layer so that a lower portion of the galvanized layer is prevented from evaporating and draining off. The method disclosed in the Patent Literature 3, however, presupposes the galvanized layer and does not practically assume the Al layer because it teaches that lower Al concentrations are better although Al is allowed to be contained up to 0.4%. In addition, the technical problem to be solved in the literature relates to Zn evaporation. This phenomenon does not occur, of course, in the case of Al plating because Al has the high boiling point.

Patent Literature 4 listed below discloses a method in which a surface coating layer containing a wurtzite-type compound is installed on the surface of an Al-plated steel sheet and then the steel sheet is subjected to hot pressing. According to the Patent Literature 4 listed below, the installation of such surface coating layer improves in lubricity in hot state and in chemical conversion treatability. This technique is effective for improving lubricity and also corrosion resistance after coated with paint. According to an example in the literature, however, the improvement in the lubricity in hot state with this technique requires application of a relatively large amount of the wurtzite-type compound, i.e., the amount being at 2 to 3 g per $m^2$.

Patent Literature 5 listed below discloses a method for obtaining a steel sheet for hot pressing that can restrain scale generation when heated before hot pressing and prevent plating materials from adhering to dies during hot pressing work. In the Patent Literature 5 listed below, the suppression of the scale generation during heating and the prevention of the plating materials from adhering to the dies during the hot pressing are achieved by means of installing a plating layer of Al—Zn based alloy on the steel sheet surface and the Al—Zn based alloy contains, Al: 20 to 95 mass %, Ca: 0.01 to 10 mass %, and Si. However, the Al—Zn based alloy plating layer disclosed in the Patent Literature 5 listed below contains Zn, which leads to metal embrittlement cracking during hot pressing work and also deterioration in spot weldability because Zn oxides are generated during hot pressing work.

Patent Literature 6 listed below discloses a method for efficiently manufacturing a hot-dip Al-plated steel sheet having less plating defects. In order to manufacture a hot-dip Al-plated steel sheet with less plating defects, according to the Patent Literature 6 listed below, a steel sheet, which is heated with predetermined conditions, is immersed, for a predetermined period of time, in an Al plating bath containing one or more of the elements of Mg, Ca, and Li. The manufacturing method according to the Patent Literature 6 listed below, however, does not intend to be applied to manufacturing steel sheets for the use of hot pressing. Accordingly, the properties of a manufactured steel sheet that are required during hot pressing work still need improvement. The Patent Literature 6 listed below also discloses the case in which Zn is added in the plating bath. Zn addition in the plating bath, however, leads to metal embrittlement cracking during hot pressing work and also to deterioration in spot weldability, which is the same as described above.

PRIOR ART LITERATURE(S)

Patent Literature(s)

[Patent Literature 1] JP 2000-38640A
[Patent Literature 2] JP 2004-211151A
[Patent Literature 3] JP 2003-129209A
[Patent Literature 4] WO 2009/131233
[Patent Literature 5] JP 2012-112010A
[Patent Literature 6] JP 4264373B

SUMMARY OF THE INVENTION

Problem(s) to be Solved by the Invention

As described in the foregoing, the Al-plated steel sheet plated with Al having the relatively high melting point is regarded as a promising member, for use as an automobile steel sheet, etc., that requires corrosion resistance. Various techniques have been proposed in applying the Al-plated steel to the process of hot pressing. In reality, however, the Al-plated steel sheet has not been applied to hot-pressed products having complicated shapes because, as one of the reasons, the Al—Fe alloy layer lacks in a satisfactory lubricity in hot pressing process. Many of the steel members for the use of automobiles are subject to paint coating after forming, and chemical conversion treatability (ability of paint coating) and corrosion resistance after coated with paint are also demanded for hot-pressed Al-plated steel sheets.

In view of the foregoing, the present invention has been made with an objective to provide a plated steel sheet for hot pressing, a hot pressing method for the plated steel sheet, and an automobile part made by the hot pressing method that has an excellent lubricity with less deposition amount and can improve formability and productivity in hot pressing work and also can improve chemical conversion treatability after hot press forming.

Means for Solving the Problem(s)

Based on the results of studies to solve the aforementioned problems, the present inventors have found that all of the aforementioned problems can be solved by adding one or more of the elements of Mg, Ca, Sr, Li, Na, and K to an Al plating layer that is formed on one side or both sides of a steel sheet and by installing a surface coating layer containing ZnO on the surface of the steel sheet, which constitutes the present invention. The gist of the present invention is described as below.

(1)

A plated steel sheet for hot pressing, including:

an Al plating layer formed on one side or both sides of the steel sheet, the Al plating layer containing at least Al, and further containing one or more elements, at a total content of 0.02 to 2 mass %, selected from Mg, Ca, Sr, Li, Na, and K; and a surface coating layer laminated on the Al plating layer and containing at least ZnO.

(2)

The plated steel sheet for hot pressing according to (1), wherein an amount of the surface coating layer on one side of the steel sheet is, as an amount of metallic Zn, 0.3 to 4 g per $m^2$.

(3)

The plated steel sheet for hot pressing according to (1) or (2), the steel sheet consisting of, in mass %, C: 0.1 to 0.4%,
Si: 0.01 to 0.6%,
Mn: 0.5 to 3%,
Ti: 0.01 to 0.1%,
B: 0.0001 to 0.1%, and
the balance: Fe and impurities.

(4)

A hot pressing method for a plated steel sheet, including:

heating the plated steel sheet including an Al plating layer formed on one side or both sides of the steel sheet, and a surface coating layer laminated on the Al plating layer and containing at least ZnO, the Al plating layer containing at least Al and further containing one or more elements, at a total content of 0.02 to 2 mass %, selected from Mg, Ca, Sr, Li, Na, and K; and pressing and forming the heated plated steel sheet.

(5)

The hot pressing method for the plated steel sheet according to (4), wherein, in heating the plated steel sheet, an average rate of temperature increase from 50° C. of a temperature state of the plated steel sheet to a temperature 10° C. lower than a maximum reaching temperature, is set 10 to 300° C. per second.

(6)

The hot pressing method for the plated steel sheet according to (4) or (5), wherein an amount of the surface coating layer on one side of the steel sheet is, as an amount of metallic Zn, 0.3 to 4 g per $m^2$.

(7)

The hot pressing method for the plated steel sheet according to any one of (4) to (6), wherein the steel sheet consisting of, in mass %, C: 0.1 to 0.4%,
Si: 0.01 to 0.6%,
Mn: 0.5 to 3%,
Ti: 0.01 to 0.1%,
B: 0.0001 to 0.1%, and
the balance: Fe and impurities.

(8)

An automobile part manufactured by the hot pressing method according to any one of (4) to (7).

(9)

The automobile part according to (8), having a mechanical strength of 1500 MPa or more.

Effect(s) of the Invention

As described in the foregoing, according to the present invention, there is provided a plated steel sheet for hot pressing, a hot pressing method, and an automobile part made thereby that are capable of improving formability and productivity in hot pressing work and improving chemical conversion treatability after hot press forming, by causing an Al plating layer of a steel sheet to contain a total content of 0.02 to 2 mass % of one or more of the elements of Mg, Ca, Sr, Li, Na, and K, and by forming a surface coating layer containing ZnO on the Al plating layer.

BRIEF DESCRIPTION OF THE DRAWING(S)

MODE(S) FOR CARRYING OUT THE INVENTION

Hereinafter, referring to the appended drawings, preferred embodiments of the present invention will be described in detail. It should be noted that, in this specification and the appended drawings, structural elements that have substantially the same function and structure are denoted with the same reference signs, and repeated explanation thereof is omitted.

First Embodiment

A plated steel sheet for hot pressing and a hot pressing method for the plated steel sheet related to the first embodiment of the present invention will be described in detail as below. The plated steel sheet for hot pressing according to the present embodiment includes an Al plating layer containing a predetermined components and a surface coating layer containing ZnO as a major component and formed on the Al plating layer. The hot pressing method for the plated steel sheet according to the present embodiment performs hot pressing on a specific Al-plated steel sheet having an Al plating layer containing a predetermined components and a surface coating layer containing ZnO as a major component and formed on the Al plating layer.

<Plated Steel Sheet>

Figure 1A:
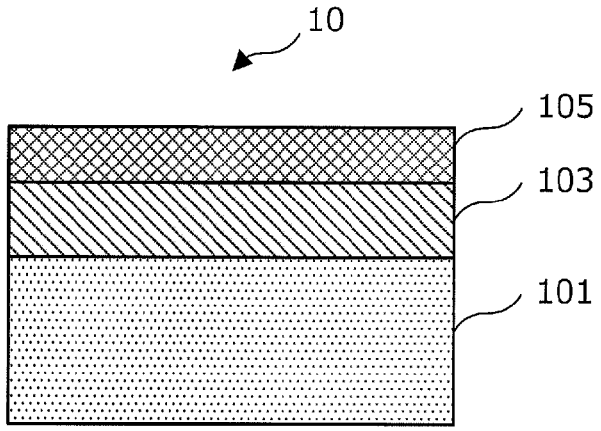
FIG. 1A is an illustration for explaining an Al-plated steel sheet related to a first embodiment of the present invention.
Figure 1B:
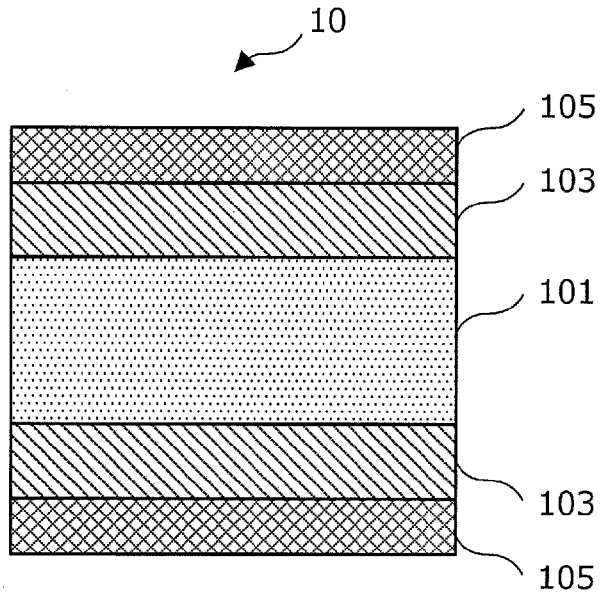
FIG. 1B is an illustration for explaining an Al-plated steel sheet related to the embodiment.

The plated steel sheet according to the present embodiment will be first explained in detail with reference to FIG. 1A and FIG. 1B. FIG. 1A and FIG. 1B are diagrammatic illustrations to show a laminar structure of a plated steel sheet according to the present embodiment.

The plated steel sheet according to the present embodiment is a plated steel sheet for hot pressing and has a high mechanical strength so that the plated steel sheet can be used, for example, for automobile parts. As shown in FIG. 1A and FIG. 1B, the plated steel sheet includes a steel sheet 101 as a base metal, an Al plating layer 103 formed on the surface of the steel sheet 101, and a surface coating layer 105 laminated on the Al plating layer 103. The Al plating layer 103 and the surface coating layer 105 may be formed on one side of the steel sheet 101 as shown in FIG. 1A or may be formed on both sides of the steel sheet 101 as shown in FIG.

1B. Each layer constituting the Al-plated steel sheet 10 according to the present embodiment will now be described in detail as below.

[Steel Sheet 101]

For the steel sheet 101 according to the present embodiment, it is preferable to use a steel sheet formed to have, for example, a high mechanical strength (which refers to properties related to mechanical deformation and failure, including, for example, tensile strength, yield point, elongation, contraction of area, hardness, impact value, fatigue strength, creep strength, etc.) If such steel sheet 101 is used, automobile parts having a high mechanical strength can be produced by hot-pressing the Al-plated steel sheet 10 having the Al plating layer 103 and the surface coating layer 105, as will be described later.

In the hot pressing process according to the present embodiment, a known steel sheet with a high mechanical strength can be utilized. A steel sheet having components as listed below may be used as the steel sheet 101 that can achieve such a high mechanical strength. Incidentally, steel components as listed below are merely exemplary, and a steel sheet usable for the hot pressing according to the present embodiment is not limited to such steel sheet as described below.

Such steel sheet 101 contains, in mass %, for example,

C: 0.1 to 0.4%,

Si: 0.01 to 0.6%,

Mn: 0.5 to 3%,

Ti: 0.01 to 0.1%, and

B: 0.0001 to 0.1%.

Such steel sheet 101 may also contain Cr, P, S, Al, N and other elements, and the balance includes Fe and impurities.

Each component added to steel will now be explained.

C is added to secure a target mechanical strength. A content of C of less than 0.1% does not provide enough mechanical strength improvement and makes C addition less effective, which is not preferable. In contrast, the C content exceeding 0.4% makes the steel sheet harden more but is more likely to cause melting cracks, which is not preferable. Accordingly, it is preferable to add C at a content of, in mass %, 0.1% or more and 0.4% or less.

Si is one of the elements for improving mechanical strength and is added to secure a target mechanical strength in a way similar to C. If the Si content is less than 0.01%, it is difficult to exhibit a hardening effect and obtain enough mechanical strength, which is not preferable. In contrast, Si is an element that is easily oxidized and thus Si content exceeding 0.6% lowers wettability during hot-dip Al plating, which is likely to cause the generation of non-plated portions, and is not preferable. Accordingly, it is preferable to add Si at a content of, in mass %, 0.01% or more and 0.6% or less.

Mn is one of the elements for strengthening steel and also one of the elements for increasing hardenability. Mn is also effective in preventing hot-brittleness caused by S that is one of the impurities. A content of Mn of less than 0.5% does not provide such effects and is not preferable. In contrast, the Mn content exceeding 3% may lower strength due to residual γ-phase becoming excessive, and is not preferable. Accordingly, it is preferable to add Mn at a content of, in mass %, 0.5% or more and 3% or less.

Ti is one of the elements for improving strength and also an element for improving the heat resistance of the Al plating layer 103 formed on the surface of the steel sheet. A Ti content of less than 0.01% cannot provide a strength-improving effect or an oxidation-resistance-improving effect, and is not preferable. In contrast, Ti is also an element that may soften steel by forming, for example, carbides and nitrides if added excessively. Particularly, if the Ti content exceeds 0.1%, it is not likely to obtain a target mechanical strength, which is not preferable. Accordingly, it is preferable to add Ti at a content of, in mass %, 0.01% or more and 0.1% or less.

B is an element for improving strength by contributing to quenching. A content of B of less than 0.0001% does not provide such strength-improving effect sufficiently, and is not preferable. In contrast, the B content exceeding 0.1% may lower fatigue strength by forming inclusions and becoming brittle, and is not preferable. Accordingly, it is preferable to add B at a content of, in mass %, 0.0001% or more and 0.1% or less.

Cr is an element having an effect for inhibiting AlN generation. AlN is generated at the interface between the Al plating layer and the steel sheet base when the Al plating layer is alloyed to form an Al—Fe alloy layer, causing the plating layer to separate from the steel sheet base. In addition, Cr is one of the elements for improving wear resistance and is one of the elements for increase hardenability. A Cr content of less than 0.05% cannot provide such effect and is not preferable. Moreover, the Cr content exceeding 2% leads to the saturation of such effect and also the cost increase, and is not preferable. Accordingly, it is preferable to add Cr at a content of, in mass %, 0.05% or more and 2% or less.

P is an inevitably-contained element while P is also an element for enhancing solid solubility. P addition can increase the strength of the steel sheet at a relatively low cost. Regarding the lower limit of a P content, it is preferable to set it to 0.001% in view of economic feasibility of steel refining. If the phosphorus content exceeds 0.1%, the toughness of the steel sheet may become low, which is not preferable. Accordingly, it is preferable to add P at a content of, in mass %, 0.001% or more and 0.1% or less.

S is an inevitably-contained element and forms MnS that generates the inclusions in steel that lead to causing fractures, hamper ductility and toughness, and deteriorate workability. Accordingly, it is preferable to lower the S content as much as possible and the upper limit of the S content is preferably set to 0.1%. On the other hand, lowering the S content will lead to an increase in production cost so that the lower limit of the S content is preferably set to 0.001%.

Al is a component contained in steel as a deoxidizer. Al is an element for hampering plating ability so that it is preferable to set the upper limit of an Al content to 0.1%. In contrast, although the lower limit of the Al content is not to be restricted, it is preferable to set the lower limit of the Al content, for example, at 0.001% in view of economic feasibility of steel refining.

N is an inevitably-contained element and is preferably fixed in view of stabilizing steel properties. N can be fixed by such elements as Ti, Al, etc. On the other hand, an increase in N content requires an increasing amount of an element used for the fixation and will lead to an increase in production cost so that it is preferable to set the upper limit of the N content to 0.01%.

Incidentally, in addition to the aforementioned elements, the steel sheet 101 may contain other impurities that are mixed in from manufacturing processes and other sources. For example, such impurities include Ni, Cu, Mo, and O.

In addition to the aforementioned elements, W, V, Nb, Sb and others may be selectively added to such steel sheet.

A steel sheet formed of such components is quenched after heated by, for example, a hot pressing method so that the steel sheet may have a mechanical strength of about 1500

MPa or more. Although the steel sheet has such a high mechanical strength, it can be shaped easily when the hot pressing method is used because the steel sheet is soften by heating and is hot-pressed in a soft state. Moreover, a high mechanical strength can be achieved for the steel sheet, and the steel sheet can maintain or improve the mechanical strength even if the thickness of the steel sheet is reduced for the purpose of weight reduction.

[Al Plating Layer 103]

As shown in FIG. 1A and FIG. 1B, the Al plating layer 103 is formed on one side or both sides of the steel sheet 101. The Al plating layer 103 is preferably formed on the surface of the steel sheet 101 by, for example, a hot-dip plating method. However, the forming method of the Al plating layer 103 is not limited to such example. The Al plating layer 103 can be formed by a known method such as electroplating, vacuum deposition, and cladding.

The Al plating layer 103 contains, as components thereof, at least Al, and one or more of Mg, Ca, Sr, Li, Na, and K at a total content of 0.02 to 2 mass %.

The present inventors have studied on the coefficient of friction of alloyed Al plating at high temperatures and made it clear that the surface configuration of the alloyed Al plating affects the coefficient of friction. In other words, a larger surface roughness after alloying makes larger the coefficient of friction at high temperatures, and therefore it is preferable to lower the surface roughness after alloying as much as possible.

In the case of pressing at the normal temperature, in general, the larger the surface roughness becomes, the smaller the coefficient of friction tends to be. It is explained that this tendency is due to the easiness in supplying lubricating oil when the surface roughness is larger. In contrast, in the high temperature pressing, such as hot pressing, on which the present embodiment focusses, the lubricating oil as used in the normal temperature pressing does not exist so that metals and oxides contact directly with each other. In such hot pressing, the one having a smaller surface roughness becomes more slippery. Although the reason is not clear enough, it is presumably because, if the surface roughness is large, the tips of the hard Al—Fe compound bite partially into the dies to make it difficult to slide against each other in a high temperature condition in which the yield stress is also lowered.

The present inventors have further found that the surface roughness after alloying can be reduced by adding one or more of Mg, Ca, Sr, Li, Na, and K to the Al plating layer 103. These elements are alkali metal or alkali earth metal elements. Although it is not clear why the surface roughness after alloying become lower when the Al plating layer 103 contains such elements, it presumably relates to the influence of surface energy of Al—Si melt generated by heating and melting the Al—Si plating at around 600° C. In the method for manufacturing an Al-based plated steel sheet according to the Patent Literature 6 listed above, one or more of Mg, Ca, and Li is contained in the Al plating bath used for the manufacturing. However, the Al-plated steel sheet manufactured by such method is not a steel sheet for hot pressing, and it is not intended in the Patent Literature 6 listed above that the formed plating layer melts during hot pressing. Therefore, it should be noted that the Patent Literature 6 listed above does not suggest anything about the reduction in the surface roughness presumably due to melting of the plating layer, which has been found by the present inventors for the first time.

To produce the aforementioned effects, these elements are added to a total concentration of 0.02 mass % or more according to the present embodiment. These alkali metals and alkali earth metals are the elements that are oxidized very easily and are also easy to be oxidized in the Al plating bath. If the addition of these elements exceeds 2 mass %, some patterns are generated on the surface of the sheet, which is derived from oxide films of these elements. Accordingly the upper limit of the addition of alkali metals and alkali earth metals is set to 2 mass %.

By including the aforementioned components in the Al plating layer 103, the surface roughness of the Al plating layer 103 becomes small, i.e., for example, about 0.4 to 1.0 μm as an arithmetic mean of roughness Ra.

When the Al plating layer 103 according to the present embodiment is formed by a hot-dip plating method, the plating bath containing the aforementioned components can be used. Si of 3 to 15 mass % may be added in the plating bath intentionally, because Si has an effect to restrain the growth of the alloy layer when a metal cover is formed by hot-dip plating. If the Si addition is less than 3 mass %, an Fe—Al alloy layer grows thick during Al plating, which may aggravate crack development in the plating layer during work and negatively impact on workability and corrosion resistance, and thus this is not preferable. On the other hand, if the Si content exceeds 15 mass %, Si is crystalized into coarse crystals in the plating layer, and the coarse crystals hamper corrosion resistance and workability in plating work, which is not preferable. Accordingly, it is preferable to add Si at a content of, in mass %, 3% or more and 15% or less.

In such plating bath, Fe and other elements that are eluted from steel sheets are mixed in as impurities. In addition, such plating bath has Al as the major element, and additive elements including Mn, Cr, Ti, Zn, Sb, Sn, Cu, Ni, Co, In, Bi, and Mo, and misch metal may be added therein. In particular, Mn, Cr, and Mo are elements effective for corrosion resistance and a small amount of them can also be added.

A deposition amount of the Al plating layer 103 is preferably 60 to 140 g per $m^2$ for both steel surfaces. A deposition amount of less than 60 g per $m^2$ does not sufficiently provide the aforementioned various effects derived from the Al-based metal cover, and is not preferable. The deposition amount exceeding 140 g per $m^2$ makes surface unevenness larger and does not provide an improvement effect in the sliding ability described above, and is not preferable. More preferably, the deposition amount of the Al plating layer 103 is 80 to 120 g per $m^2$ for both sides.

The Al plating layer 103 formed of such components can prevent the steel sheet 101 from corroding. The Al plating layer 103 can also prevent the steel sheet from generating the scales (iron oxides) that are generated by the oxidization of the steel sheet surfaces that are heated to a high temperature when shaping the steel sheet by the hot pressing method. Accordingly, installation of such Al plating layer 103 can omit such processes as scale removing, surface cleaning, and surface treatment, and thus can improve productivity. The Al plating layer 103 has the boiling point higher than that of a plating cover formed by organic-based materials or by metal-based materials (for example, Zn-based material). This allows the steel sheet to be shaped at high temperature in the shaping work using the hot pressing method, which leads to further improvement in formability during the hot pressing and also leading to easiness in shaping.

In addition, B, when contained in the steel sheet 101 as a chemical component, improves the strength of the steel sheet during quenching. Furthermore, B functions synergistically with the Al plating layer 103 and can further improves various properties of the plated steel sheet in hot pressing.

As described in the foregoing, a part of Al contained in the Al plating layer 103 can be alloyed with Fe contained in the steel sheet during metal cover forming by hot-dip plating and during the heating phase of hot pressing. Accordingly, the Al plating layer 103 is not necessarily formed as one single layer having a constant content of components but contains a partially alloyed layer (alloy layer) therein.

[Surface Coating Layer 105]

The surface coating layer 105 according to the present embodiment is a coating layer that includes ZnO (zinc oxide) as a major component and is laminated on the surface of the Al plating layer 103. The surface coating layer 105 may be formed using a liquid in which particles are suspended in various solvents including, for example, water or organic solvents. Such surface coating layer 105 provides an effect of improving lubricity during hot pressing and reactivity in the reaction with a chemical conversion liquid.

Besides ZnO, the suspension for forming the surface coating layer 105 may contain, for example, an organic binder component. Such organic binder component may be a known water-soluble resin such as, for example, polyurethane resin, polyester resin, acrylic resin, and a silane coupling agent. As oxides besides ZnO, for example, $SiO_2$, $TiO_2$, and $Al_2O_3$ may be added.

Such surface coating layer 105 may be formed using a known application method. Such application method may include, for example, a method in which the aforementioned suspension is mixed with a predetermined organic binder component and applied onto the surface of the Al plating layer with a roll coater and the like, and a method for applying by powder coating.

Although a grain size of ZnO to be used is not limited here, it is preferable to have a grain size of, for example, about 50 to 1000 nm in diameter. The grain size of ZnO in the range above allows the coating to adhere securely. Incidentally, the grain size of ZnO is defined as the grain size after heating treatment. Typically, the grain size is to be determined by observation with a scanning electron microscope (SEM) or an equivalent device after undergoing the process in which a sample is retained in a 900° C. furnace for 5 to 6 minutes and rapidly cooled with dies. In the sample to be observed, only oxides remain to exist because organic contents in the binder have been decomposed.

A content of the organic binder component such as a resin component and a silane coupling agent is preferably about 3 to 30% as a mass ratio of the binder component to ZnO. A binder content of less than 3% does not provide the binder effect sufficiently and tends to cause the separation of the coating layer before heating, which is not preferable. To obtain the binder effect stably, it is more preferable to contain the organic binder component at a mass ratio of 10% or more. On the other hand, if the content of the organic binder component exceeds a mass ratio of 30%, odor generation during heating becomes noticeable, which is not preferable.

An application amount (deposition amount) of such surface coating layer 105 is set to 0.3 to 4 g per $m^2$ as an amount of metallic Zn for one side of the steel sheet. A ZnO content of 0.3 g per $m^2$ of metallic Zn or more efficiently provides effects including lubricity improvement. If the ZnO content exceeds 4 g per $m^2$ of metallic Zn, the thickness of the Al plating layer 103 and the surface coating layer 105 becomes excessive, which deteriorates weldability and coating adhesion. It is more preferable that the deposition amount of the surface coating layer 105 is about 0.5 to 2 g per $m^2$. By keeping the deposition amount in such range, the lubricity in hot pressing is secured and the weldability and the coating adhesion become better.

The amount of metallic Zn of the surface coating layer 105 can be measured by either of what is called a wet method or a dry method that are widely used. For example, if the wet method is employed, the Al-plated steel sheet 10 is immersed in acid such as hydrochloric acid, sulfuric acid, or nitric acid to solve the plating layer, and the solution in which the plating layer is solved can be analyzed to determine the amount of Zn by using inductively coupled plasma (ICP) atomic emission spectrometry. If the dry method is employed, for example, the Al-plated steel sheet 10 is cut into a predetermined piece, which can be analyzed to determine the Zn content using fluorescent X-ray analysis.

As a method for baking and drying after coating application, known methods including, for example, an air-heating furnace, an induction heating furnace, a near infrared ray furnace, and the like, can be utilized separately or in combination. In this process, other hardening treatments may be carried out, depending on the type of binder to be used, by using, for example, ultraviolet ray, electron beam, or the like instead of baking and drying after coating application.

When the organic binder component is not used, the adhesion of coating after applied onto the Al plating layer 103 is slightly low and the coating may be coming off when rubbed strongly.

As described in the foregoing, the surface coating layer 105 according to the present embodiment exerts effects including the improvement of lubricity during hot pressing work so that the formability during pressing and the corrosion resistance after pressing can be improved. Moreover, the surface coating layer 105 is excellent in lubricity, which restrains adhesion to the dies. In a case where powdering of the Al plating layer 103 occurs, the surface coating layer 105 prevents the powder (Al—Fe powder, etc.) from adhering to the dies that are used for the subsequent pressings. Consequently, this omits the process for removing the Al—Fe powder that adheres to the dies, and can further improve productivity.

Furthermore, the surface coating layer 105 can function as a protection layer to prevent the steel sheet 101 and the Al plating layer 103 from receiving scratches that may occur during pressing work, and can also improve formability. In addition, the surface coating layer 105 does not impair usability such as spot weldability and painting adhesion. Consequently, the corrosion resistance after coated with paint improves significantly, which can further reduce the deposition amount of plating. As a result, this further reduces the adhesion in rapid pressing, leading to further improvement in productivity.

Referring to FIGS. 1A and 1B, the Al-plated steel sheet 10 used in the hot pressing method according to the present embodiment has been so far described in details.

<Shaping by Hot Pressing Method>

Described now will be a process in which the Al-plated steel sheet 10 having the above-described configuration is shaped by hot pressing method.

In the hot pressing method according to the present embodiment, the Al-plated steel sheet 10, which is blanked as required, is heated first to a high temperature to soften the steel sheet. The softened Al-plated steel sheet 10 is pressed and shaped, and then the shaped Al-plated steel sheet 10 is cooled. The temporarily-softened steel sheet can make the following pressing work easier. The steel sheet having the aforementioned components is, by undergoing heating and cooling, quenched to obtain a high mechanical strength of about 1500 MPa or more.

The Al-plated steel sheet 10 according to the present embodiment is heated for carrying out hot pressing. The heating method is not particularly limited but a known method such as an electric furnace, a radiant tube furnace, or infrared heating can be utilized.

In the heating, the Al-plated steel sheet 10 melts at the melting point or a temperature higher than the melting point and, at the same time, changes into an Al—Fe alloy layer and an Al—Fe—Si alloy layer due to counter diffusion with Fe. The Al—Fe alloy layer and the Al—Fe—Si alloy layer have the high melting points, i.e., around 1150° C. A plurality of species of such Al—Fe compounds and Al—Fe—Si compounds exist and are transformed into compounds having a higher Fe concentration by heating to a high temperature or heating for a long period of time. The surface state preferable for a final product is that alloying proceeds to the surface and, at the same time, the Fe concentration in the alloy layer is not high. If unalloyed Al remains to exist, this portion corrodes rapidly, resulting in being quite vulnerable to cause blistering of the paint coating in terms of the corrosion resistance after coated with paint, which is not preferable. On the other hand, if the Fe concentration in the alloy layer becomes too high, the corrosion resistance of the alloy layer itself becomes lower, which also results in being vulnerable to cause blistering of the paint coating in terms of the corrosion resistance after coated with paint. This is because the corrosion resistance of the alloy layer depends on the Al concentration in the alloy layer. Consequently, there exist a desirable alloying state in terms of the corrosion resistance after coated with paint, and the alloying state is determined based on the deposition amount of plating and the heating conditions.

In the hot pressing method for the plated steel sheet according to the present embodiment, when the Al-plated steel sheet 101 is heated, an average rate of temperature increase can be set to 10° C. to 300° C. per second in the high temperature range of the steel sheet that is 50° C. to a temperature 10° C. lower than the maximum reaching temperature. The average rate of temperature increase in heating affects productivity in pressing work of the plated steel sheet. A typical average rate of temperature increase is, for example, about 5° C. per second under the high temperature condition in the case of atmospheric heating. An average rate of temperature increase of 100° C. per second or more can be achieved by electric heating or high-frequency induction heating.

As described above, the high average rate of temperature increase can be achieved for the Al-plated steel sheet 10 according to the present embodiment, which enables improvement in productivity. The average rate of temperature increase affects the composition and thickness of the alloy layer and is one of the important factors for controlling the product quality of plated steel sheets. The rate of temperature increase can be increased to 300° C. per second for the Al-plated steel sheet 10 according to the present embodiment, which allows the product quality to be controlled in a wider range. In terms of the maximum reaching temperature, a temperature ranging typically from about 900 to 950° C. is often adopted because the steel sheet needs to be heated to a temperature in an austenite region as required from hot pressing principles. Although the maximum reaching temperature is not particularly limited in the present embodiment, the temperature of 850° C. or less is not likely to provide a sufficient quenching hardness, and is not preferable. The temperature of 850° C. or less is not preferable also because the Al plating layer 103 must be changed into the Al—Fe alloy layer. If alloying develops excessively at a temperature exceeding 1000° C., the Fe concentration increases in the Al—Fe alloy layer, which may cause deterioration in corrosion resistance after coated with paint. Although this depends on the rate of temperature increase or on the deposition amount of the Al plating, it is not desirable, also from economic point of view, to heat to a temperature of 1100° C. or more.

<Example of Effect by Hot Pressing Method>

The plated steel sheet and the hot pressing method for the plated steel sheet according to the first embodiment of the present invention have been so far described. The plated steel sheet 10 according to the present embodiment has the Al plating layer 103 that further includes at least one element that is selected from alkali earth metal and alkali metal elements, and has the surface coating layer 105 that mainly includes ZnO. As a result, for example, a high lubricity is achieved and chemical conversion treatability is improved as described previously.

The reason why ZnO contributes to the adhesion of the chemical conversion coating is not clear at the present stage. While the chemical conversion reaction is triggered and made to proceed by the etching reaction in which acid reacts with a material; ZnO is an amphoteric compound and is solved in acid so that ZnO reacts with the chemical conversion liquid.

The hot pressing method for the plated steel sheet according to the embodiment of the present invention has been so far described in detail.

EXAMPLES

The plated steel sheet for hot pressing and the hot pressing method for the plated steel sheet according to the present invention will now be described concretely by showing the present examples and comparative examples. Incidentally, the Examples of the plated steel sheet for hot pressing and the hot pressing method for the plated steel sheet according to the present invention, which are described below, are merely exemplary, and the plated steel sheet for hot pressing and the hot pressing method for the plated steel sheet according to the present invention are not limited to such examples as described below.

Example 1

A cold-rolled steel sheet (sheet thickness of 1.4 mm) having steel components as shown in Table 1 below was used. Both sides of the cold-rolled steel sheet was plated with Al. The annealing temperature used was about 800° C. Si of 9 mass % had been added to the Al plating bath and Fe that had been eluted from other steel strips was contained therein. Ca, Mg and other elements were added in the Al plating bath. Table 2 below shows the elements and their amounts that were added in the bath. The deposition amount after plating was adjusted by a gas wiping method to 120 g per $m^2$ for both sides. The ZnO suspension that contains an amount of acrylic binder of 20 mass % as a ratio to the ZnO amount was applied onto the cooled Al-plated steel sheet with a roll coater. The coated Al-plated steel sheet was baked at about 80° C.

Properties of the sample prepared as described above were evaluated by the method described below.

TABLE 1

| Steel Components of the Al-plated Steel Sheet (in mass %) | | | | | | | |
|---|---|---|---|---|---|---|---|
| C | Si | Mn | P | S | Ti | B | Al |
| 0.22 | 0.13 | 1.20 | 0.005 | 0.002 | 0.02 | 0.004 | 0.03 |

(1) Lubricity in Hot State

The lubricity in hot state was evaluated by carrying out a test for pulling out the sample from dies in hot state. More specifically, an Al-plated steel sheet of 30 mm by 350 mm was heated to 900° C. The Al-plated steel sheet was then pressed on both sides by plate dies made from SKD11 at 700° C., and then the Al-plated steel sheet was drawn. The pressing load and the pull-out load were measured, and the coefficient of friction in hot state was determined as the value obtained from the formula: Pull-out Load/(2*Pressing Load).

(2) Strength of Spot-Welded Joint

The above sample was placed in a furnace and heated at 900° C. of a sample temperature for 6 minutes. Immediately after taken out, the sample was held between stainless steel dies and rapidly cooled. The cooling rate was about 150° C. per second. Cross tension strength was then measured in accordance with JIS Z3137. The welding condition for the sample was as below. The test was conducted 3 times each and the average strength of the joint was calculated.

Electrode: chromium-copper alloy, DR (40R with 8 mm in tip diameter)

Pressure: 880 kgf (1 kgf is about 9.8 N)

Current applying time: upslope 3 cycle—current applying 22 cycle (60 Hz)

Welding current: 9.5 kA (3) Corrosion Resistance after Coated with Paint

The above sample was placed in a furnace and heated at 900° C. of the sample temperature for 6 minutes. Immediately after taken out, the sample was held between stainless steel dies and rapidly cooled. The cooling rate was about 150° C. per second. The cooled sample was then sheared into a piece of 70 mm by 150 mm and subjected to chemical conversion treatment using chemical conversion liquid (PB—SX35) available from Nihon Parkerizing Co., Ltd. The sample was then coated with electro-deposition paint (Powernics 110) available from Nippon Paint Co., Ltd. to a film thickness of 15 μm and was baked at 170° C. of the sample temperature.

The corrosion resistance after coated with paint was evaluated in accordance with JASO M609 established by the Society of Automotive Engineers of Japan. More specifically, the paint film was cross-cut with a cutter and was subjected to a corrosion test of 180 cycles (60 days). The width of blistering of the paint coat from the cross-cut (maximum value on one side) was then measured. An alloyed hot-dip galvanized steel sheet of 45 g per $m^2$ on one side was also evaluated as a comparative sample. The above sample can be determined to be usable as an anticorrosive steel sheet if the above sample is better than the comparative sample in terms of the corrosion resistance after coated with paint. For the comparative sample, the width of blistering of the paint coat was 5 mm.

Incidentally, a sample of 70 mm by 150 mm to which a thermocouple was welded was placed in an air atmosphere furnace being set at 900° C. of the sample temperature in order to measure the sample temperature from 50° C. to 890° C. and calculate the average rate of temperature increase, the result of which was 4.7° C. per second.

Table 2 below summarizes plating compositions and obtained evaluation results. Table 2 below lists the amount of metallic Zn measured by fluorescent X-ray analysis for an amount of the coating of the surface coating layer. In addition, measured results of coefficient of kinetic friction are listed for the lubricity in hot state, and measured values of cross tension strength are listed for the spot joint strength. For the corrosion resistance after coated with paint, also listed are measured values of the maximum width of blistering of the paint coat on one side after the cross-cut.

TABLE 2

| Plating compositions and property evaluation results | | | | | | | |
|---|---|---|---|---|---|---|---|
| No. | Element added in plating bath | Added amount (mass %) | Amount of coating of surface coating layer (g per $m^2$) | Lubricity in hot state | Spot joint strength (kN) | Corrosion resistance after coated with paint (mm) | Remark |
| 1 | none | none | none | 0.70 | 7.5 | 7.2 | comparative example |
| 2 | none | none | 1.0 | 0.60 | 7.4 | 4.5 | comparative example |
| 3 | none | none | 3.1 | 0.54 | 6.7 | 3.0 | comparative example |
| 4 | none | none | 5.0 | 0.53 | 5.5 | 2.8 | comparative example |
| 5 | none | none | 6.8 | 0.52 | 4.1 | 2.8 | comparative example |
| 6 | Mg | 1 | none | 0.59 | 7.5 | 5.0 | comparative example |
| 7 | Mg | 1 | 1.1 | 0.50 | 7.4 | 3.3 | present invention example |
| 8 | Mg | 1 | 2.0 | 0.49 | 7.2 | 2.7 | present invention example |
| 9 | Mg | 1 | 3.3 | 0.48 | 6.6 | 2.3 | present invention example |

TABLE 2-continued

Plating compositions and property evaluation results

| No. | Element added in plating bath | Added amount (mass %) | Amount of coating of surface coating layer (g per $m^2$) | Lubricity in hot state | Spot joint strength (kN) | Corrosion resistance after coated with paint (mm) | Remark |
|---|---|---|---|---|---|---|---|
| 10 | Mg | 1 | 4.5 | 0.47 | 5.7 | 2.2 | present invention example |
| 11 | Mg | 0.5 | 1.0 | 0.51 | 7.6 | 3.5 | present invention example |
| 12 | Mg | 1.5 | 1.0 | 0.50 | 7.5 | 3.1 | present invention example |
| 13 | Mg | 2.5 | 1.0 | — | — | — | comparative example |
| 14 | Li | 0.04 | 1.0 | 0.51 | 7.4 | 3.3 | present invention example |
| 15 | Li | 0.1 | 1.0 | 0.50 | 7.6 | 3.2 | present invention example |
| 16 | Li | 0.3 | 1.0 | 0.50 | 7.5 | 3.1 | present invention example |
| 17 | Ca | 1 | 1.0 | 0.50 | 7.4 | 3.2 | present invention example |
| 18 | Sr | 1 | 1.0 | 0.51 | 7.5 | 3.4 | present invention example |
| 19 | Na | 0.1 | 1.0 | 0.50 | 7.4 | 3.4 | present invention example |
| 20 | K | 0.1 | 1.0 | 0.50 | 7.5 | 3.3 | present invention example |
| 21 | Mg, Li | 0.1 each | 1.0 | 0.50 | 7.6 | 3.2 | present invention example |
| 22 | Mg, Ca | 0.5 each | 1.0 | 0.50 | 7.5 | 3.3 | present invention example |

For Sample Nos. 1 to 5, any additive elements such as Mg, Ca, or else were not added in the plating bath. These samples showed that as the surface coating becomes thicker, the lubricity in hot state and the corrosion resistance improve while the spot joint strength decreases. For Sample Nos. 1 to 5, it was difficult to satisfy all of the properties. It was shown that the corrosion resistance after coated with paint decreased for Sample No. 6 in which Mg was added in the plating bath but the surface coating layer was not formed. In contrast, the evaluation results of Sample Nos 7 to 12 showed that Mg addition in the plating bath improves both the lubricity in hot state and the corrosion resistance, causing a required coating amount to be smaller. As a result, decrease in the spot joint strength became smaller, which enabled all the properties to be satisfied.

Sample No. 13 is the case in which Mg was added at 2% or more. In this case, oxidation on the bath surface was too intense to obtain Al plating having a satisfactory appearance. Sample Nos. 14 to 22 are the cases in which a species or an amount of (an) element(s) added in the bath was changed. Each of the Samples provided good results in the properties.

Figure 2:
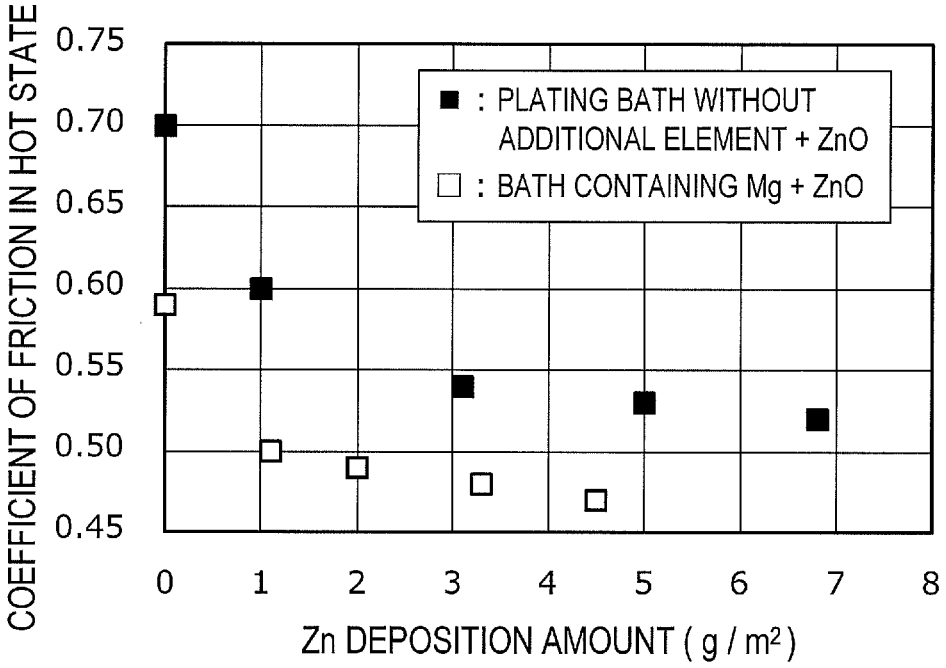
FIG. 2 is a graph for explaining an Example.

FIG. 2 focuses on Sample Nos. 1 to 10 and summarizes the change in measured values for coefficient of friction in hot state relative to the change in the Zn deposition amount.

FIG. 2 clearly shows that the value for the coefficient of friction in hot state can be made smaller by adding Mg in the plating bath and by forming the surface coating layer 105 on the Al-plated steel sheet, as compared to cases in which the predetermined components are not added in the plating bath. It is also apparent that, when the amount of coating of the surface coating layer 105 is at the same level, a smaller coefficient of friction in hot state can be achieved by using the plating bath containing Mg. These results shows that, in achieving a certain value for the coefficient of friction in hot state, the amount of coating of the surface coating layer 105 can be made smaller by using the plating bath containing the predetermined elements such as Mg.

Example 2

Sample No. 2 and Sample No. 7 available from Example 1 were heated by far-infrared radiation. A two-zone furnace having a temperature rising zone and a holding zone were used for this purpose, and the samples were manually transferred between zones. The rate of temperature increase was changed by varying the temperature of the sample temperature in the temperature rising zone from 1000° C. to 1150° C. The holding zone was set to 900° C. of the sample temperature. A thermocouple was welded to the sample of 70 mm by 150 mm. When the temperature of the temperature rising zone reached 850° C., the sample was transferred to the holding zone. At this time, the average rate of temperature increase from 50 to 890° C. was calculated using the same method as in Example 1. Quenching was carried out as was done in Example 1 and the evaluation after this was conducted in the same way as in Example 1. Obtained evaluation results are shown in Table 3 below.

TABLE 3

| Properties in Rapid Heating | | | | | |
|---|---|---|---|---|---|
| No. | Lubricity in hot state | Rate of temperature increase (° C. per sec) | Spot joint strength (kN) | Corrosion resistance after coated with paint (mm) | Remark |
| 2 | 0.48 | 17 | 7.4 | 4.1 | comparative example |
| 7 | 0.40 | 17 | 7.4 | 2.7 | present invention example |
| 7 | 0.40 | 12 | 7.4 | 2.9 | present invention example |

Comparing Table 3 above with Table 2 clearly shows that when the rate of temperature increase is large, the lubricity in hot state and the corrosion resistance after coated with paint are improved. In the case of rapid increase in temperature, the surface roughness became smaller, and the structure after alloying was changed. These phenomena probably affected such properties.

Example 3

Rapid heating using electric heating was conducted. A sample for this was prepared using the plating bath corresponding to Sample No. 7 of Example 1, with an Al plating having a deposition amount of 80 g per $m^2$ for both sides and a ZnO coating applied thereon having a deposition amount of 1 g per $m^2$. The obtained steel sheet of 100 by 300 mm were pinched by electrodes at both ends and heated electrically. For this heating, the average rate of temperature increase from 50 to 890° C. was 88° C. per second. The sample was evaluated in the same way as in Example 1. The results were 0.41 for the lubricity in hot state, 7.3 kA for the spot joint strength, and 3.6 mm for the corrosion resistance after coated with paint. Based on these results, the rapid heating by electric heating was confirmed to provide similar effects.

As described in the foregoing, owing to the present invention, the lubricity has become better and the workability has improved in carrying out hot pressing of the Al-plated steel sheet, which enables more complicated pressing. Also enabled are labor saving in maintenance work of hot pressing equipment and an increase in productivity. After hot pressing, the paint coating and the corrosion resistance of finished products are confirmed to improve because the chemical conversion treatability becomes better. In view of the above, the present invention is sure to expand the application range of hot pressing of Al-plated steel and to enhance applicability of Al-plated steel materials to final products such as automobiles and industrial machines.

Heretofore, preferred embodiments of the present invention have been described in detail with reference to the appended drawings, but the present invention is not limited thereto. It should be understood by those skilled in the art that various changes and alterations may be made without departing from the spirit and scope of the appended claims.

REFERENCE SIGNS LIST

10 Al-plated steel sheet
101 steel sheet
103 Al plating layer
105 surface coating layer

The invention claimed is:

1. A plated steel sheet for hot pressing, comprising:
an Al plating layer formed on one side or both sides of the steel sheet, the Al plating layer containing at least Al, and further containing Si of 3 to 15 mass % and one or more elements, at a total content of 0.02 to 2 mass %, selected from Mg, Ca, Sr, Li, Na, and K; and
a surface coating layer laminated on the Al plating layer and containing at least ZnO, wherein
the Al plating layer contains a partially alloyed layer therein obtained by alloying a part of Al contained in the Al plating layer with Fe contained in the steel sheet during metal cover forming by hot-dip plating,
surface roughness of the Al plating layer is 0.4 to 1.0 μm as an arithmetic mean of roughness Ra,
an amount of the surface coating layer on one side of the steel sheet is, as an amount of metallic Zn, 0.3 to 1.1 g per $m^2$, and
the steel sheet consisting of, in mass %,
C: 0.1 to 0.4%,
Si: 0.01 to 0.6%,
Mn: 0.5 to 3%,
Ti: 0.01 to 0.1%,
B: 0.0001 to 0.1,
P: 0.001 to 0.1%,
S: 0.001 to 0.1%,
Al: 0.001 to 0.1%,
N: 0.1% or less; and
optionally one or more of W, V, Nb, and Sb; and
the balance: Fe and impurities.

2. A hot pressing method for a plated steel sheet according to claim 1, comprising:
heating the plated steel sheet including an Al plating layer formed on one side or both sides of the steel sheet, and a surface coating layer laminated on the Al plating layer and containing at least ZnO, the Al plating layer containing at least Al and further containing Si of 3 to 15 mass % and one or more elements, at a total content of 0.02 to 2 mass %, selected from Mg, Ca, Sr, Li, Na, and K; and
pressing and forming the heated plated steel sheet, wherein
the Al plating layer contains a partially alloyed layer therein obtained by alloying a part of Al contained in the Al plating layer with Fe contained in the steel sheet during metal cover forming by hot-dip plating,
surface roughness of the Al plating layer is 0.4 to 1.0 μm as an arithmetic mean of roughness Ra,
an amount of the surface coating layer on one side of the steel sheet is, as an amount of metallic Zn, 0.3 to 1.1 g per $m^2$ ,and
the steel sheet contains, in mass %,
C: 0.1 to 0.4%,
Si: 0.01 to 0.6%,
Mn: 0.5 to 3%,
Ti: 0.01 to 0.1%,
B: 0.0001 to 0.1,
P: 0.001 to 0.1%, S: 0.001 to 0.1%,
Al: 0.001 to 0.1%,
N: 0.1% or less, and
optionally one or more of W, V, Nb, and Sb; and
the balance: Fe and impurities.

3. The hot pressing method for the plated steel sheet according to claim 2, wherein, in heating the plated steel sheet, an average rate of temperature increase from 50° C. of a temperature state of the plated steel sheet to a temperature 10° C. lower than a maximum reaching temperature, is set 10 to 300° C. per second.

4. An automobile part manufactured by the hot pressing method according to claim 2.

5. The automobile part according to claim 4, having a mechanical strength of 1500 MPa or more.

* * * * *